US009394150B2

(12) United States Patent
Bow et al.

(10) Patent No.: US 9,394,150 B2
(45) Date of Patent: Jul. 19, 2016

(54) CRADLE RETAINER FOR MATERIAL HANDLING

(71) Applicants: Ronald Bow, Corfu, NY (US); D. Keith Bow, Corfu, NY (US)

(72) Inventors: Ronald Bow, Corfu, NY (US); D. Keith Bow, Corfu, NY (US)

( * ) Notice: Subject to any disclaimer, the term of this patent is extended or adjusted under 35 U.S.C. 154(b) by 118 days.

(21) Appl. No.: 14/105,236

(22) Filed: Dec. 13, 2013

(65) Prior Publication Data

US 2014/0166405 A1 Jun. 19, 2014

Related U.S. Application Data

(60) Provisional application No. 61/736,640, filed on Dec. 13, 2012.

(51) Int. Cl.
*B66F 9/18* (2006.01)

(52) U.S. Cl.
CPC ..... *B66F 9/18* (2013.01)

(58) Field of Classification Search
CPC ..... B66F 9/18; B66F 9/182
USPC ..... 187/237
See application file for complete search history.

(56) References Cited

U.S. PATENT DOCUMENTS

| | | | | |
|---|---|---|---|---|
| 1,617,839 | A | 2/1927 | Fennell | |
| 1,732,829 | A | 10/1929 | Boardman | |
| 2,690,271 | A | 9/1954 | Marietta | |
| 2,918,186 | A | 12/1959 | Cirillo | |
| 3,080,080 | A | 3/1963 | Miller | |
| 3,223,259 | A | 12/1965 | Nicholson | |
| 3,229,825 | A | 1/1966 | Brown | |
| 3,472,363 | A | 10/1969 | Rustin | |
| 3,511,400 | A | 5/1970 | Oswald | |
| 3,561,628 | A | 2/1971 | Melin | |
| 4,183,710 | A * | 1/1980 | Burdick | B60V 3/025 180/119 |
| 4,503,978 | A | 3/1985 | Smit et al. | |
| 4,781,271 | A | 11/1988 | Wokeck | |
| D318,805 | S | 8/1991 | Imeson | |
| 5,221,176 | A | 6/1993 | Allen et al. | |
| 5,413,054 | A | 5/1995 | Collins | |
| 5,544,719 | A * | 8/1996 | Boriani | B62B 3/06 187/237 |
| 5,575,608 | A | 11/1996 | Yau et al. | |
| 5,618,159 | A | 4/1997 | Wilson | |
| D385,080 | S | 10/1997 | Schueneman et al. | |
| 5,897,286 | A | 4/1999 | Whittaker | |
| 6,439,528 | B1 | 8/2002 | Goto et al. | |
| 6,471,465 | B2 | 10/2002 | Albertyn | |
| 6,550,741 | B1 | 4/2003 | Cottone | |

(Continued)

FOREIGN PATENT DOCUMENTS

| | | |
|---|---|---|
| DE | 3607481 | 10/1986 |
| DE | 3916434 | 11/1990 |

(Continued)

*Primary Examiner* — William E Dondero
*Assistant Examiner* — Diem Tran
(74) *Attorney, Agent, or Firm* — Duane C. Basch; Basch & Nickerson LLP

(57) ABSTRACT

A material handling system for supporting and retaining a cylindrical object being transported, such as on the forks of a lift truck. Each support includes a backplane having a curved or wedge-shaped portion on opposing ends. The resilient material of the support or cradle conforms to a range of diameters to retain the position of the object on the forks, as well as to displace the weight of the object over a extended area. Straps may be used to further bind the object to the lifting system.

19 Claims, 8 Drawing Sheets

(56) References Cited

U.S. PATENT DOCUMENTS

| | | | | |
|---|---|---|---|---|
| 6,860,496 | B2 * | 3/2005 | Novak | B62B 5/049 211/20 |
| D523,610 | S | 6/2006 | Kissell | |
| 7,244,084 | B2 | 7/2007 | Anthony et al. | |
| 7,314,215 | B2 | 1/2008 | Vosoughkia | |
| 8,118,180 | B2 | 2/2012 | Van Belkom | |
| 8,801,005 | B1 * | 8/2014 | Flickner | B62B 3/04 280/35 |
| 2004/0161327 | A1 | 8/2004 | Paxton et al. | |
| 2008/0164101 | A1 * | 7/2008 | Stone | B66F 9/06 187/231 |
| 2008/0310946 | A1 | 12/2008 | Allen | |
| 2009/0028682 | A1 | 1/2009 | Monroe | |
| 2009/0260551 | A1 | 10/2009 | Mattson | |
| 2009/0297320 | A1 * | 12/2009 | Daraie et al. | 414/785 |
| 2010/0189536 | A1 | 7/2010 | Morgan et al. | |
| 2013/0259618 | A1 * | 10/2013 | McGrane et al. | 414/671 |
| 2013/0277151 | A1 * | 10/2013 | Giannetti | 187/237 |

FOREIGN PATENT DOCUMENTS

| | | |
|---|---|---|
| EP | 0563837 | 10/1993 |
| WO | WO 2012104564 A1 * | 8/2012 |

* cited by examiner

CRADLE RETAINER FOR MATERIAL HANDLING

This application claims priority under 35 U.S.C. §119 from U.S. Provisional Patent Application No. 61/736,640, for a CRADLE RETAINER FOR MATERIAL HANDLING, filed Dec. 13, 2013 by R. Bow and D. K. Bow, which is hereby incorporated by reference in its entirety.

Disclosed herein is a material handling system for supporting a cylindrical or curved-surface object while transported on forks, and more particularly a device(s) for reducing the propensity of a cylindrical object to move while in transport, said device comprising a deformable curvilinear material to provide both protection of the object as well as chocking of the object.

BACKGROUND AND SUMMARY

It is well known in material handling to palletize products into standard dimensional configurations for the purpose of efficient handling, transporting, stacking and subsequent storage, perhaps in a warehouse location. However, the handling of items during the manufacturing process and pre-shipping often requires piecemeal management, whereby transfer of the articles of manufacture are performed one or more at a time without the advantage of protective packing materials and/or pallets. Accordingly, great care and special considerations must be exercised so as not to cause damage to work in progress, or the finished goods, by the handling equipment.

Industrial lift trucks, or forklifts as they are more commonly known, are routinely used in the manufacturing and service industries to lift and transport materials from one location to another through the use of a pair of forwardly extending spaced apart steel forks that are intended to raise and support such objects during a transfer operation. Often times the materials to be transported have specific form factors that are more difficult to handle than others because they lack a lifting surface area that is co-planar with the lifting forks. For example, an upright 55 gallon drum is stable and easily engaged under the bottom of one flat end, however when placed on its side, the cylindrical shape of such a drum has a tendency to roll about due to gravity and inertia, as it is moved around. Hence, securing cylindrical objects having a high aspect ratio remains to be an ongoing problem for forklifts requiring further methods or tools to mitigate damage to goods caused by rolling, collisions, and scaring, as well as promoting safety. Accordingly there has been a long felt need for safely handling heavy, cumbersome loads that are generally cylindrical in shape, in order to mitigate damage to the object including, deformation, gouging and or fracturing at the point of contact with the fork, as well as dropping or collision with other objects as the load rolls about on the forks.

One aspect of the disclosed embodiments provides an enhanced contact surface between the lifting forks and a cylindrical object. Accordingly, it is an object of the disclosed embodiments to provide a cradle that is compliant with the outer surface of the cylindrical load to retain the object on the forks.

It is another object of the disclosed embodiments to ensure that the outer surface finish of the object being transported is unaffected by engagement with the forks.

It is yet another object of the disclosed embodiments to minimize relative motion between the object being lifted or moved and the forks of the lift, and the disclosed embodiments include both a curvilinear/inclined surface as the interface between the forks and the object, as well as hold down mechanisms to which additional straps or other hold-down mechanisms can be attached in order to minimize motion. It is a further objective of the disclosed embodiments to provide a magnetic attachment capability for easy use and storage of the disclosed retainers.

Disclosed in embodiments herein is a materials handling system for supporting a cylindrical object, comprising: an elongated backplane; a wedge on the distal end of said backplane; a wedge on the proximal end of said backplane; and a compliant surface spanning the backplane and both distal and proximal wedges, said surface at least partially displaced by the object to retain the position of the object.

Further disclosed in embodiments herein is a materials handling system suitable for supporting a cylindrical object on flat forks of a forklift, comprising: a pair of saddles, wherein each saddle includes a shallow V-shaped notch; and a compliant surface, said surface at least partially displaced by the object to retain the position of the object; and a pair of channels, each of said pair of channels having a hollow region therethrough such that said hollow region is of a size suitable to receive a fork of the forklift therein, each of said channels having one of said saddles operatively attached thereto.

Also disclosed herein is a method of manufacturing a saddle for supporting a cylindrical object, comprising: forming an elongated backplane of a material having a first density, forming a wedge on the distal end of said backplane, wherein at least a portion of said wedge includes a material of a second density, different than the first density; and forming a wedge on the proximal end of said backplane, wherein at least a portion of said wedge includes a material of a second density, different than the first density.

Other and further objects, features and advantages will be evident from a reading of the following description and by reference to the accompanying drawings forming a part thereof.

Figure 1:
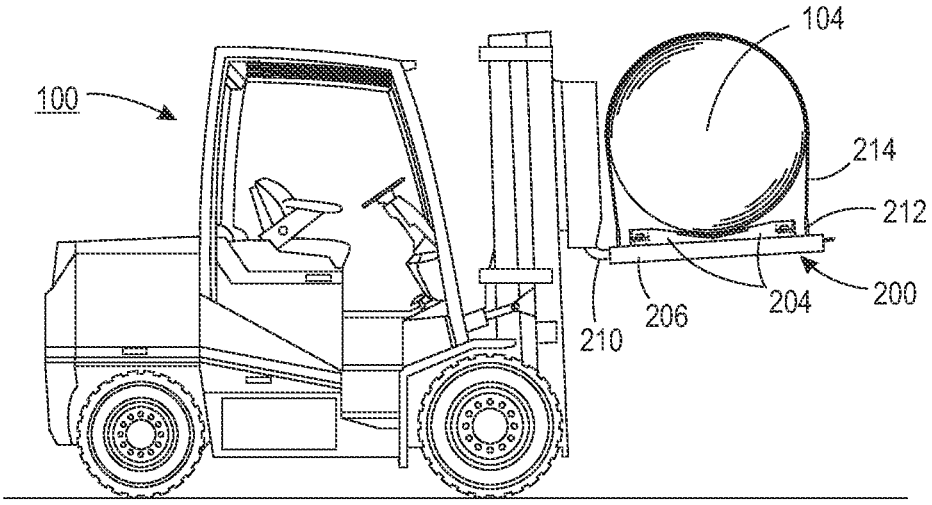
FIG. 1 is an overall side view of the present disclosed material handling system in use.

The various embodiments described herein are not intended to limit the invention to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Referring now to the drawings wherein the showings are for purposes of illustrating an embodiment of the material handling system. Securing system 102, represented in FIG. 1, depicts an overview of the principle elements of a material handling system for use on a fork lift, including fork truck 100 and cylindrical object or load 104 on forks 210 extending from the forklift. A pair of cradle-shaped retainers or saddles 200, with wedges 204 on opposing ends thereof to form a shallow V-shaped notch, is placed on top of hollow rectangular channel 206. Mounting straps 214, attached to hold-down mechanism 212 located at the proximal and distal ends of channels 206, preclude rotational movement of a cylindrical object 104 and restrain what may be an unbalanced load so the load may be lifted and transported using the forklift.

Figure 2:
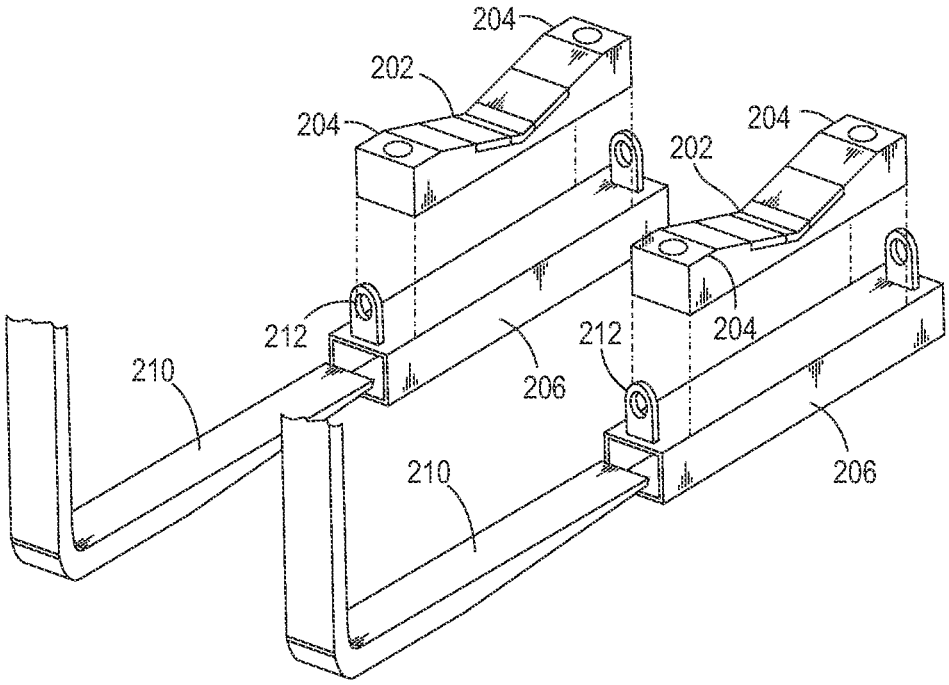
FIG. 2 is an isometric exploded view of the channels and interface spacers in relationship to the lifting forks.

Also referring to FIG. 2, in accordance with a disclosed embodiment wedges 204 and backplane 202 are shown in an assembly-type relationship operatively attached to channels 206. The ramped area of wedge spacer 204 is ideally suited to comply with the radial surface of object 104 through the use of a variable density material whereby the reactive force and displacement is proportional to the weight and radius of the object, as explained in further detail below. Backplanes 202 are positioned on rectangular fork channels 206, for example using magnets or any other suitable fastening means, such as Velcro®, adhesive, bolts, rivets, vulcanizing and the like. It is contemplated that one or more of the fastening means may be added to the backplane 202 during its formation, or may be inserted or attached to the backplane after formation. For example, the attachment means such as a bolt, washer, etc. may be molded into the backplane at formation, or may be added during a post-formation operation. Rectangular fork channels 206 are spaced a distance apart from one another, beneath a cylindrical load, to coincide with the separation of the forks, so as to readily engage or disengage with the forks 210 of lift 100.

Figure 3:
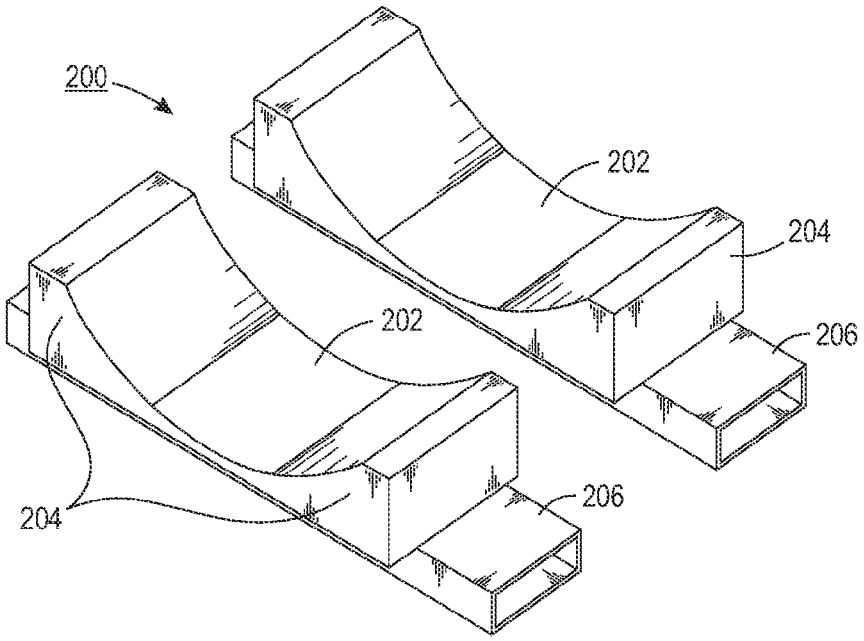
FIG. 3 is an isometric view of a pair of cylindrical interface spacers.
Figure 4:
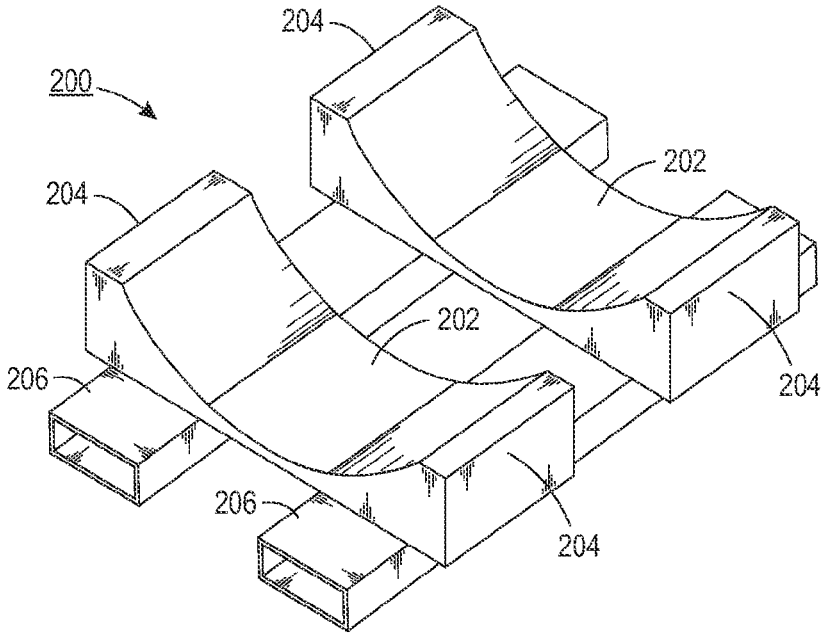
FIG. 4 is an isometric view of FIG. 3 having the wedge spacers rotated 90 degrees.

Turning now to FIG. 3 and FIG. 4, one example of cradle-shaped retainers 200 is shown in a ready for use condition to receive a cylindrical object for transporting. As illustrated respectively by FIGS. 3 and 4, the object may be picked up perpendicular to or parallel to the forks of the lift 100. Channels 206 provide a way for the forks to be inserted under the wedge spacers 204 so the load positioned between cradle-shaped retainers 200 can be engaged and lifted vertically and subsequently transported. Also contemplated is the possibility that the channels themselves also span between the forks 210, similar to the manner illustrated in FIG. 4, such that the channels then provide further support for a load resting thereon. In such an embodiment, the channels may have slots cut through their sides to receive the forks. As contemplated, the use of channels 206 in conjunction with the wedge spacers 204 is optional when there is room to directly insert the forks under the load (e.g., when the load has blocks or other structure supporting it above a surface).

Figure 5:
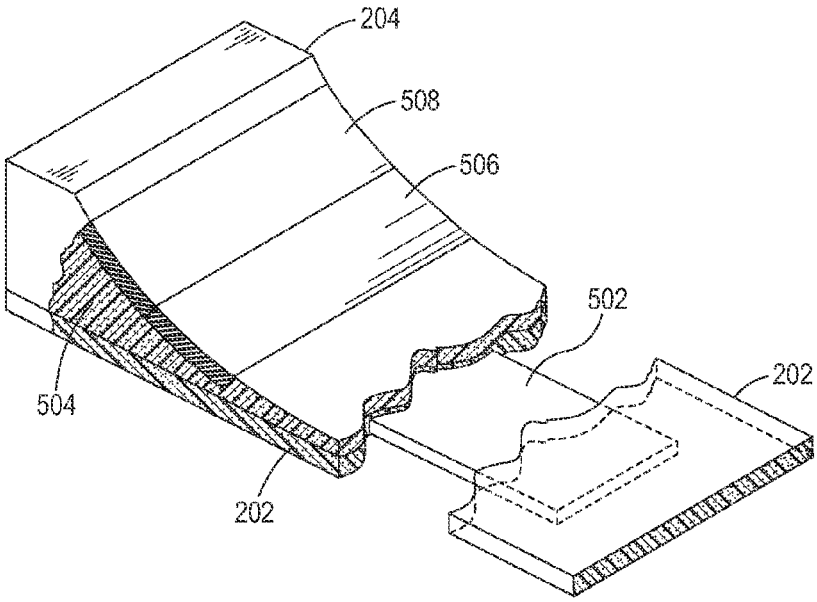
FIG. 5 is a cutaway view of one embodiment of a wedge spacer having a variable density, and a magnet for attachment.

Notably, the versatility of cradle-shaped retainers 200 lends well to a range of object diameters and configurations due to the compliant properties of both the backplane portion 202 as well as the more compliant surfaces such as spacers 204, as shown in the cross-sections of FIG. 5. Understanding that as the diameter and weight of the material or object increases, spacers 204, and to a smaller extent backplane 202, have a tendency to conform to the radial surface. For example, the nominal radius of the face of cradle-shaped retainers 200 can be larger or smaller than the diameter of the load itself, yet the resilient material used for the backplane and wedges and its V-shaped configuration, conforms to the surface to increase the contact surface area and thereby displaces the reactive force applied to the load. Consequently the cradle-shaped retainers 200, and more specifically at least wedges 204, are designed to provide a cross section having layers of material with dissimilar densities, such as resilient material layers 508 and 506. Alternatively, it is conceivable that spacer 204 be fabricated from a compliant material using a known method that provides for a non-linear density profile of spacer 204, not unlike that used in a foam mattress, where weight, relative to compression, is a non-proportional function.

In one embodiment, the layers of material that are in contact with or closest to the cylindrical load are more compliant (e.g., less dense) than the outer and/or base (backplane) layer (s) of the cradle-shaped retainers 200. Although depicted as layers having variable density, it is further contemplated that the variation in density of the materials may also be accomplished through the use of additives or manufacturing methods, such that the resilient material employed is consistent throughout, but that the addition of other materials, or even the introduction of voids (e.g., bubbles), is suitable to alter the material in a manner to produce the desired variability in the material in order to partially conform to the load surface.

Having illustrated a variable density composition 504 for wedge 204 in FIG. 5, also shown is at least one magnet 502 is embedded within or attached along at least a portion of the backplane. Such a magnet would likely be a permanent magnet suitable to maintain the position of the cradle-shaped retainer 200 on the forks 210 of lift 100, or in the alternative, magnetically attached to channels 206 or other component to which the cradle or saddle is attached. In one embodiment, magnet 502 is a switchable on/off magnet such as the MagJig 150 or similar permanent magnets, such as those available from Magswitch® Technology Worldwide, Westminster, Colo. (e.g., Part No. 8110005), and is inserted into a routed receiving pocket 308 (e.g., FIGS. 12, 17) in one or both ends of the retainers 200 such that the bottom magnetizable surface of the magnet is generally flush with the bottom of the backplane layer 202. The switchable magnet provides the ability to position the retainer with the magnet off and then hold the retainer in position by engaging the magnet. While depicted as inserted within a hole or recess in the ends of the retainer 200, it is also conceivable that the on/off activation of the magnet is accomplished via other actuators (e.g., buttons on the sides of the retainer), and that the magnet 502 is embedded within or permanently attached to the retainer.

Figure 6:
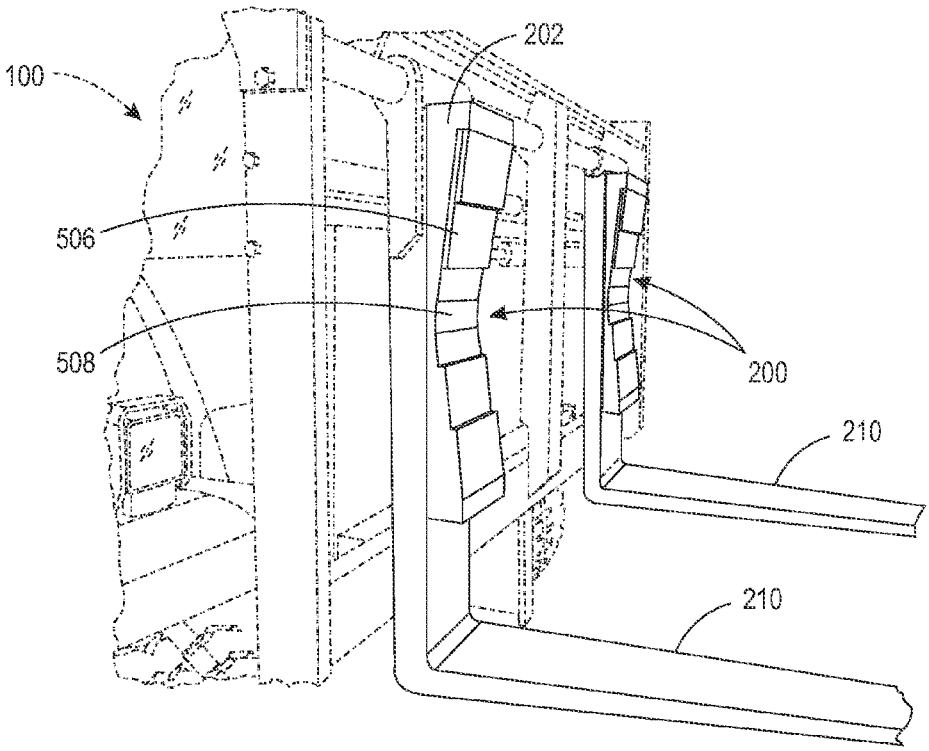
FIG. 6 is an isometric view having the spacers shown in a storage position.

Magnet 502 is intended to hold wedge spacers 204 in position when a load is not present. Additionally one or more magnet(s) 502 further provide a means to store the cradle-shaped retainer 200 as seen in FIG. 6, where the saddle is stored on the forward face of a lift fork 210. It is also noted that the cradle-shaped saddle or retainer 200 may also be used in the position indicated in FIG. 6 as a bumper or pad when lifting cylindrical or other loads with the forks. Therefore, the same magnets 502 can be used to retain the cradle-shaped retainer 200 on the vertical surface of the forks or fork lift for storage or use, or on the horizontal surface of forks 210 when needed to stabilize a cylindrical load or similarly-shaped load.

Figure 7:
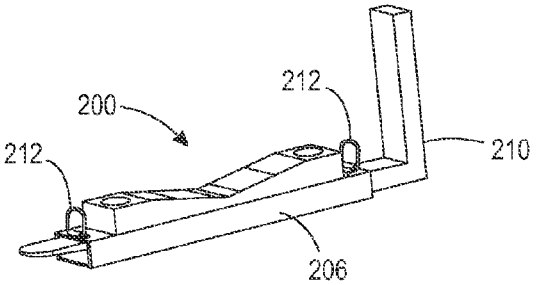
FIG. 7 is a pictorial perspective view of an embodiment of the materials handling system including the saddle and mounting channel.
Figure 8:
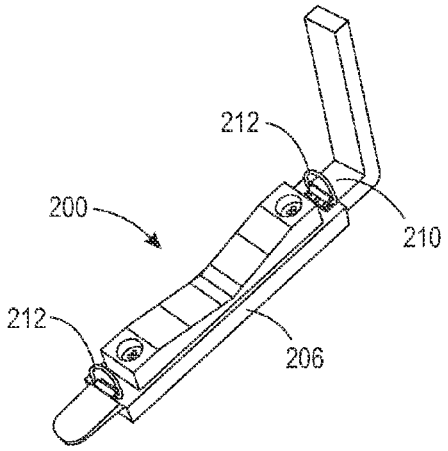
FIG. 8 is a top perspective view of the materials handling system of FIG. 7.

Referring briefly to FIGS. 7 and 8, depicted therein are cradles or saddles 200 along with channels 206 and associated cleats or hold-down mechanism 212 in two different perspectives. As illustrated in FIG. 1, for example, the cleats 212 may be used to apply straps 214, chains, turnbuckles and the like so as to further stabilize the load being transported on the forks. It will be further appreciated that alternative hold-down mechanisms and fasteners and the like may be employed to stabilize the load resting on the channels and/or cradle-shaped retainer 200. For example, the hold down mechanisms may not only be cleat-type devices or hooks, but also hold down mechanisms such as staples (stationary, hinged, articulating), shackles, transport loops, anchor plates, etc. that are suitable for temporary or permanent attachment of a hook or loop of a fastening device thereto.

Figure 9:
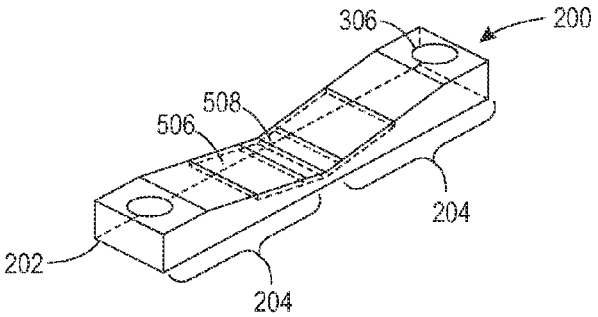
FIG. 9 is a hidden-line perspective view of the saddle depicted in FIG. 7.

FIG. 9 provides a perspective view of the cradle-shaped retainer 200. As illustrated in FIG. 9, the wedges on the proximal and distal ends of the retainer are generally the same size; however the wedges 204 may also be of different shapes, heights or material configurations on the opposite ends. A configuration with different-size wedges, or wedges comprised of different materials, thicknesses, etc., may be employed in particular circumstances where there is a desire for a wedge of a different height or density on the leading edge of the fork. Moreover, the backplane itself may be formed using sheets of material laminated to form thicker profiles. In the embodiment of the cradle-shaped retainer 200 in FIG. 9, is illustrated as having a base (black) layer 202 plus two additional layers (red) 506 and (white) 508. FIGS. 7-9 not only show the cradle-shaped retainer 200 having laminations or layers as previously described, but as illustrated in FIGS. 13-15, the base and layers of the retainer are able to deform and conform under a load so as to reliably maintain the position of a load 104 while in transport on the forks 210

Figure 10:
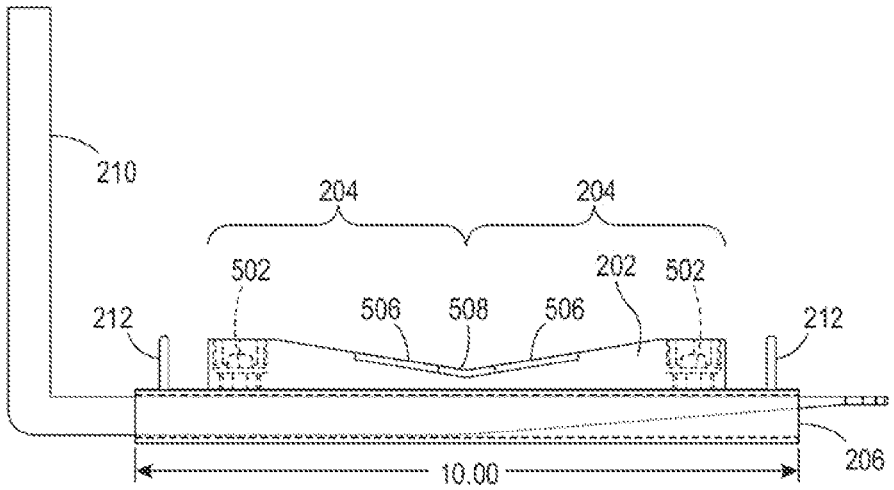
FIGS. 10-12 are isometric drawings showing dimensional details of the embodiment depicted in FIGS. 7-9.
Figure 11:
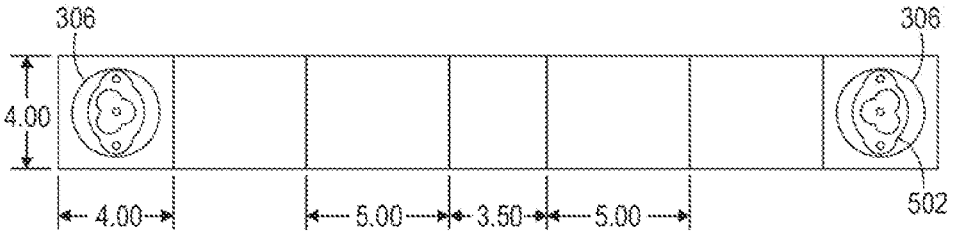
Figure 12:
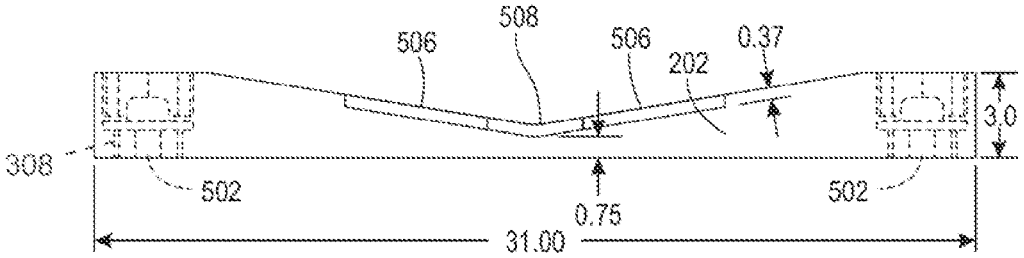

Turning next to the engineering drawings depicted in FIGS. 10-12, the drawings are intended to show the dimensional aspects of an embodiment of the cradle-shaped retainer 200 where the representative dimensions are set forth in units of inches. More specifically, FIG. 10 is a side view of the materials handling system installed on a forklift fork 210, where the fork has been slidably inserted into and through an interior or hollow region of the channel 206. On the channel a compliant cradle-shaped saddle or retainer 200 is attached, as are one or more hold-down mechanisms 212 as described above. The retainer 200 is, as illustrated in the side view, formed in a shallow V-shape, and includes not only a base or backplane layer 202, but may further include layers 506 and 508 of materials having different densities or characteristics. Also illustrated at both the distal and proximal ends of the base layer 202 are recesses into which permanent magnets 502 are inserted and attached to the retainer. In one embodiment, the magnets are operatively attached to the retainer via a molded insert to which the magnets are connected by a fastener such as a threaded screw or bolt and nut arrangement. It is also possible that the permanent magnet may be a separate layer or strip located on or within the backplane layer. Other methods of attaching the magnet to the base layer are also contemplated, including adhesives as well as molding the magnet into the base layer as it is being formed. FIGS. 10-12 not only show the cradle-shaped retainer 200 having laminations or layers as previously described, but as described previously, the base and layers of the retainer are able to deform and conform under a load so as to reliably maintain the position of a load 104 while in transport on the forks 210, for example as depicted in FIGS. 13-15. Although FIGS. 10-12 illustrate layers 506 and 508 on the base layer 202, an embodiment of the cradle-shaped retainer 200, with only a base layer and a single additional layer, is also contemplated.

Figure 13:
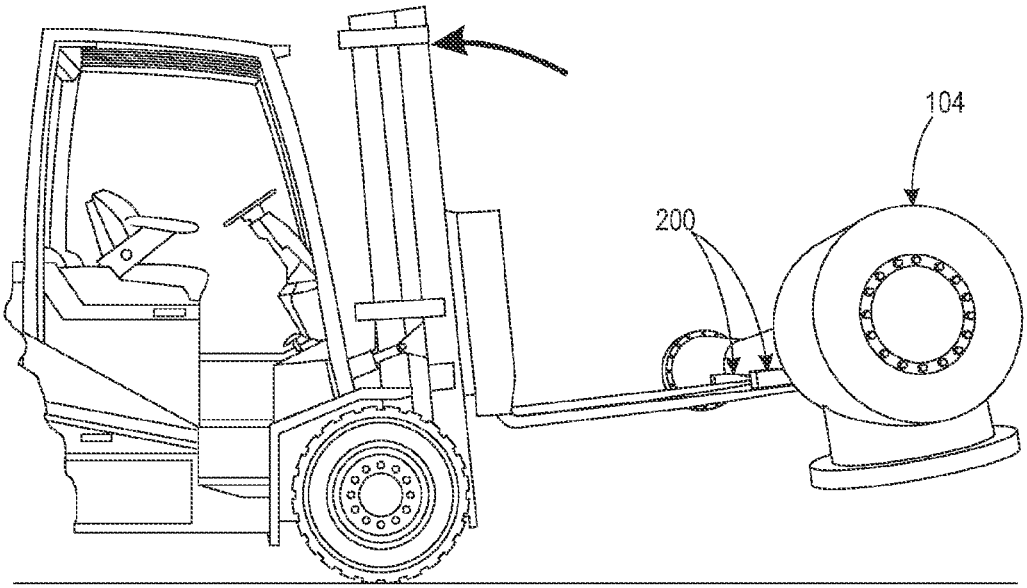
FIGS. 13-15 are illustrative examples of the disclosed material handling system used to support a load in various orientations.
Figure 14:
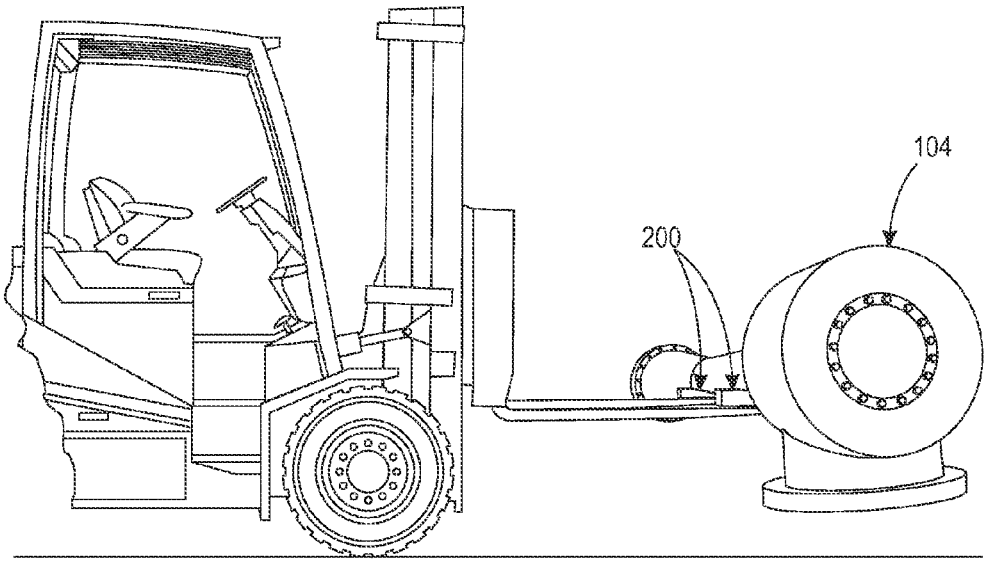
Figure 15:
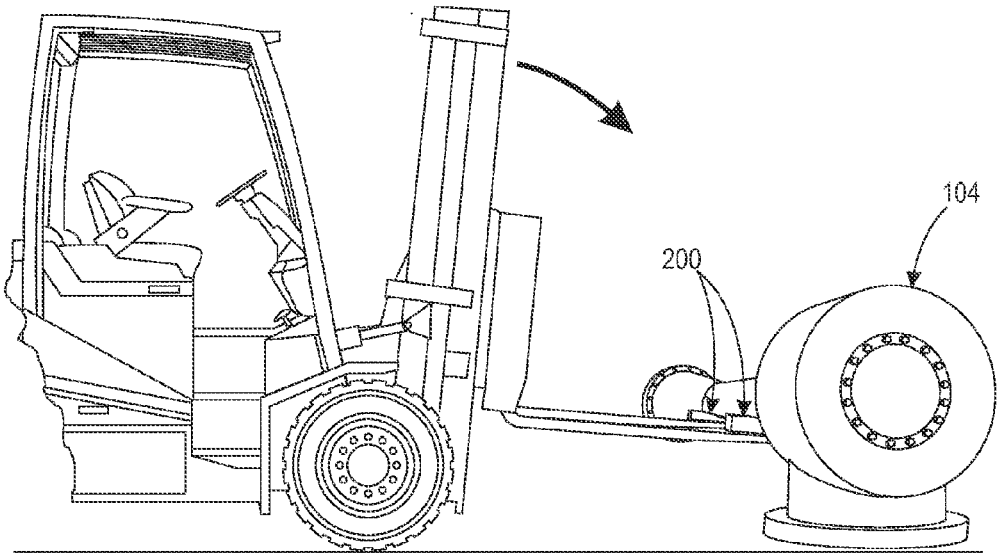

Considering the photos of FIGS. 13-15, for example, depicted therein is an illustration of the use of cradle-shaped retainers 200 and the relative positions of the forks of the lift are illustrated as tipping upward (FIG. 15), flat (FIG. 14) and tipping down (FIG. 13). The illustration indicates the ability of the cradle-shaped retainer 200 to retain the position of the load in spite of the angle of the forks being changed (note that there is no rotation of the load even though it is not strapped or otherwise restrained).

Figure 16:
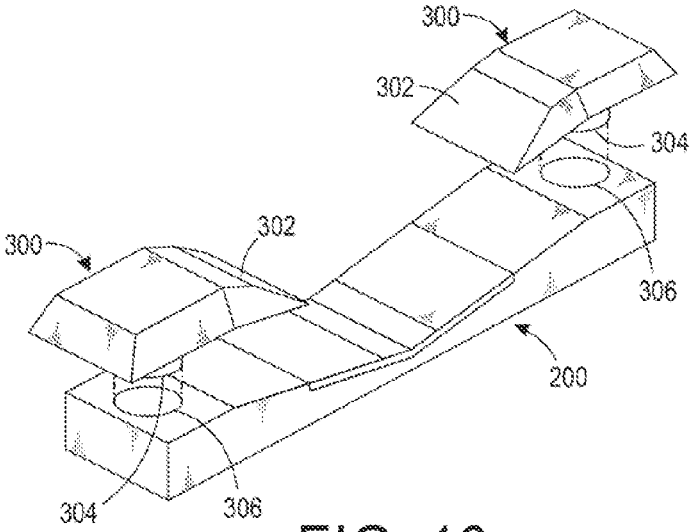
FIGS. 16-18 are illustrations of an alternative embodiment of the material handling system, including at auxiliary wedge.
Figure 17:
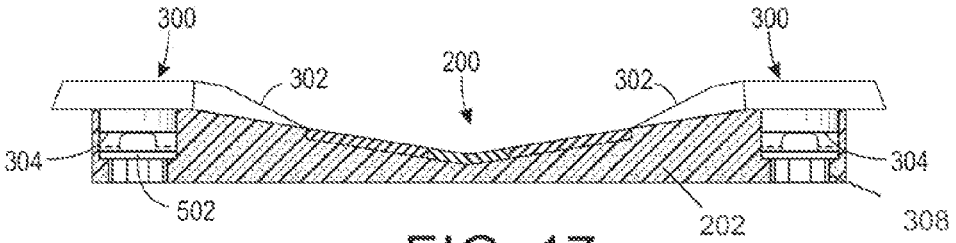
Figure 18:
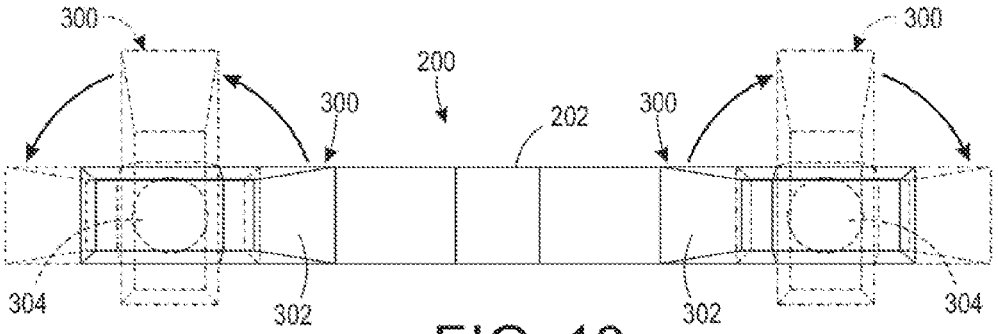

Turning next to FIGS. 16-18, depicted therein is an alternative embodiment of the disclosed materials handling system further including an auxiliary wedge 300 on each end of the retainer 200. Referring to FIGS. 16 and 17, retainer 200 is as described in the embodiments above, but in some situations dealing with larger diameter loads or very heavy loads, it may be desirable to include additional material on the ends of the retainer. Auxiliary wedge 300 provides the additional material and includes a plug 304 that fits within a corresponding hole 306 in the end of the retainer 200. Thus, as illustrated in the figures, wedge 302 may be added along the top of the retainer on one or both ends, providing a further wedge-shaped inclined region 302. Auxiliary wedge 300 is made from the same materials as the backplane, or may be made from alternative materials that are more of less dense depending upon the nature of the load being stabilized. As will be appreciated, the addition of the auxiliary wedge increases the height of the V-shaped profile of the material handling system.

Also referring to FIG. 18, while one side of the auxiliary wedge 300 is designed to match the profile of the upper portions of the backplane and top layers of the retainer 200, other sides of the auxiliary wedge may have differently shaped profiles in order to make a variety of profiles available when the auxiliary wedge is added to the end of the retainer. The various orientations of attachment are illustrated in the dashed line representations of FIG. 18, but it will be appreciated that with a round profile for plug 304 and hole 306, it is possible for the auxiliary wedge to present numerous wedge profiles or faces to a load. With the round shape of plug 304, it is also possible to rotate the auxiliary wedge relative to retainer 200 between its various profiles as illustrated by the arrows and thereby adjust the profile for particular situaitons. Although illustrated as a series of wedge shapes, it will be appreciated that the auxiliary wedge itself could be of any shape that may be suitable for the load being stabilized by the system, and all that is necessary is that the auxiliary wedge mate with hole 306 (e.g., a slight interference fit) or another feature on the surface of the retainer 200.

In recapitulation, as seen in FIG. 1 etc., a load 104 having a curvilinear surface 102 is securely retained upon a planar fork(s) having at least two pairs of cradle-shaped retainers 200 with wedge-shaped spacers 204, not only to prevent rolling, but also to displace the load over a wider surface area. Additionally, wedges 204 and backplane 202 further serve to protect the surface finish of the load from direct contact with forks 210, which are typically contaminated with a broad spectrum of materials and debris that could adversely affect the surface of the load being transported. Moreover, by stabilizing the load, the safety of the operator, and those nearby, is enhanced as well as reducing the potential for damage to the material by unrestricted rolling or slipping.

While specific examples have been described for handling round materials in the specification and illustrated in the drawings, it will be understood, by those skilled in the art, that various changes to the interface assembly may be made and equivalents may be substituted for elements thereof without departing from the scope of the present teachings herein. It will be appreciated that several of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. A materials handling system for supporting a cylindrical object, comprising:

an elongated backplane including an upper surface and a generally planar lower surface;

a wedge on a distal end of said elongated backplane;

a wedge on a proximal end of said elongated backplane;

wherein the generally planar lower surface of said backplane is defined by a single plane extending from the distal end of said elongated backplane to the proximal end of said elongated backplane, and where the wedge on the distal end of said elongated backplane and the wedge on the proximal end of said elongated backplane meet to form a shallow V-shaped profile having an apex; and a compliant surface spanning the elongated backplane and both the wedge on the distal end of said elongated backplane and the wedge on the proximal end of said elongated backplane, said compliant surface at least partially displaced by the cylindrical object to retain a position of the cylindrical object while the generally planar lower surface of said elongated backplane remains planar.

2. The materials handling system of claim 1, further comprising an elongated rectangular channel operatively attached to an underside of said elongated backplane, said channel being suitable for slideably receiving a fork therein.

3. The materials handling system of claim 2, further comprising a hold-down mechanism disposed near opposing ends of said elongated rectangular channel for securing a load using a securing member attached to said hold-down mechanism.

4. The materials handling system of claim 2, wherein said elongated backplane is attached to a surface of said channel using a magnetic force.

5. The materials handling system of claim 4, wherein the magnetic force is created by a permanent magnet operatively attached to the elongated backplane.

6. The materials handling system of claim 1, wherein a magnetic force attaches said elongated backplane to a surface.

7. The materials handling system of claim 6, wherein said magnetic force is provided by at least one on/off switchable magnet inserted within a receiving pocket in said elongated backplane.

8. The materials handling system of claim 1, wherein at least one of the wedge on the distal end of said elongated backplane and the wedge on the proximal end of said elongated backplane has a non-uniform density.

9. The materials handling system of claim 1 further comprising at least one auxiliary wedge operatively attached to one of the wedge on the distal end of said elongated backplane and the wedge on the proximal end of the elongated backplane.

10. A materials handling system suitable for supporting a cylindrical object on flat forks of a forklift, comprising:

a pair of cradle-shaped saddles, wherein each saddle includes a shallow V-shaped notch having an apex near the center of the saddle, and a compliant surface, said compliant surface at least partially displaced by the cylindrical object to retain the position of the cylindrical object; and a pair of enclosed channels, each of said pair of channels having a hollow region therethrough such that said hollow region is of a size suitable to receive one of said flat forks of the forklift therein, each channel of said pair of enclosed channels having one saddle of said pair of cradle-shaped saddles operatively attached thereto.

11. The materials handling system of claim 10, wherein each saddle of said pair of cradle-shaped saddles further includes an elongated backplane, a wedge on a distal end of said backplane, and a wedge on a proximal end of said backplane.

12. The materials handling system of claim 11, wherein at least one saddle of said pair of cradle-shaped saddles further includes at least one auxiliary wedge operatively attached to one of the wedge on the distal end of said backplane and the wedge on the proximal end of the backplane.

13. The materials handling system of claim 10, wherein each saddle of said pair of cradle-shaped saddles includes at least one magnet to operatively attach said saddle to one channel of said pair of channels.

14. The materials handling system of claim 13, wherein said compliant surface is formed using materials having different densities.

15. The materials handling system of claim 10, further comprising a hold-down mechanism on opposing ends of each of the channels of said pair of enclosed channels, said hold-down mechanism being available for securing a load using said hold-down mechanism.

16. A method of manufacturing a saddle for supporting a cylindrical object, comprising:

forming an elongated backplane of a material having a first density, forming a wedge on a distal end of said elongated backplane, wherein at least a portion of said wedge includes a material of a second density, different than the first density; and forming a wedge on a proximal end of said elongated backplane, wherein at least a portion of said wedge includes a material of the second density;

wherein the wedge on the distal end of said elongated backplane and the wedge on the proximal end of said elongated backplane meet to form a shallow V-shaped profile having an apex.

17. The method of claim 16, further comprising, attaching at least one magnet to the elongated backplane.

18. The method according to claim 17, wherein the operation of attaching at least one magnet includes inserting an on/off switch type magnet into a pocket in at least the wedge on a distal end of said elongated backplane and the wedge on a proximal end of said elongated backplane.

19. The method according to claim 16 further comprising attaching an auxiliary wedge to at least one of the wedges formed on the distal end of the elongated backplane or formed on the proximal end of the elongated backplane.

* * * * *